US005829913A

United States Patent [19]

Puckett

[11] Patent Number: 5,829,913

[45] Date of Patent: Nov. 3, 1998

[54] BOLLARD CAP

[76] Inventor: Robert Puckett, 515 N. University Ave., Norman, Okla. 73609

[21] Appl. No.: 775,304

[22] Filed: Dec. 31, 1996

[51] Int. Cl.[6] ..... E01F 9/011

[52] U.S. Cl. ..... 404/6; 404/9; 340/932.2; 340/933; 340/937

[58] Field of Search ..... 404/6, 9, 10, 11, 404/84.05, 84.5, 14, 12, 13; 256/1, 13.1; 116/63 P, 63 R; 340/932.2, 933, 937, 943

[56] References Cited

U.S. PATENT DOCUMENTS

| | | | |
|---|---|---|---|
| 1,973,275 | 9/1934 | Babson | 340/932.2 X |
| 2,121,961 | 6/1938 | Gill | 116/63 P X |
| 2,237,536 | 4/1941 | Wells | 116/63 R X |
| 2,625,130 | 1/1953 | Morser | 116/63 P X |
| 2,646,638 | 7/1953 | Peterson | 116/63 P |
| 5,265,556 | 11/1993 | Hall | 116/63 P |
| 5,397,197 | 3/1995 | Beavers | 404/11 X |
| 5,500,642 | 3/1996 | Battle | 404/11 X |
| 5,597,262 | 1/1997 | Beavers et al. | 404/6 |

*Primary Examiner*—James Lisehora
*Attorney, Agent, or Firm*—Hill & Simpson

[57] ABSTRACT

A bollard or safety post cap for closing an open end of a vertical member of the bollard. The cap includes a anchor member extending downwardly from the cap to be embedded in the concrete which fills the pipe section of the bollard for ease of installation of the cap. The cap can include an electronic component such as security sensors or other devices.

25 Claims, 2 Drawing Sheets

FIG. 1
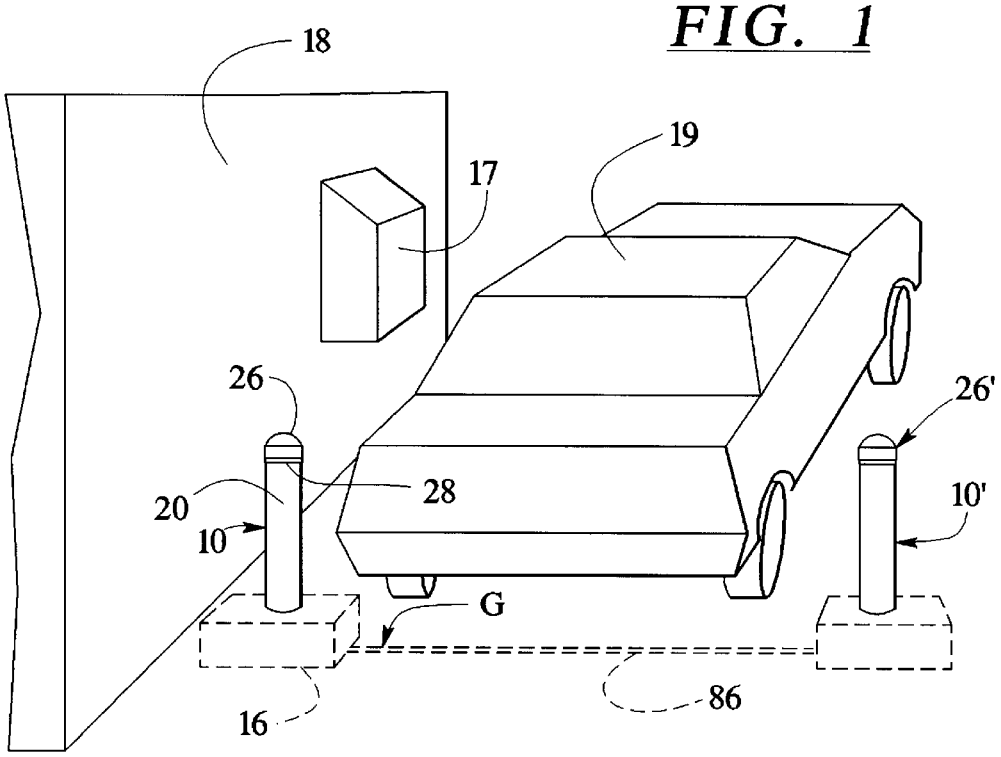
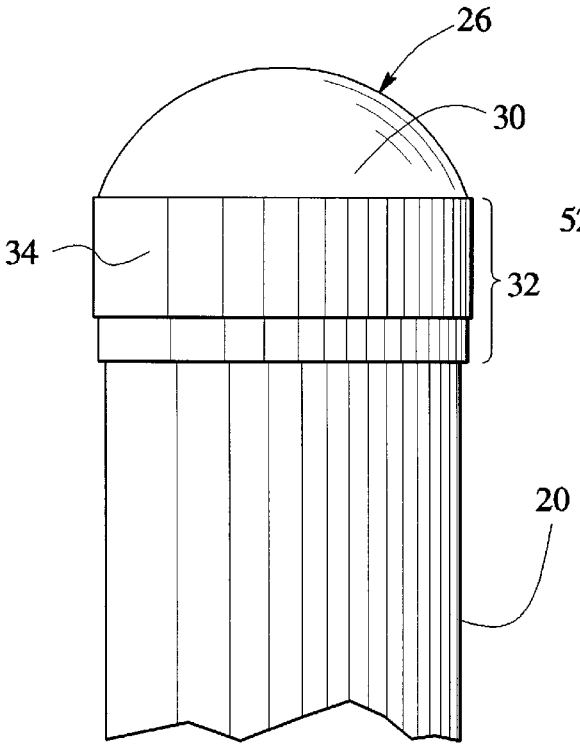
FIG. 2
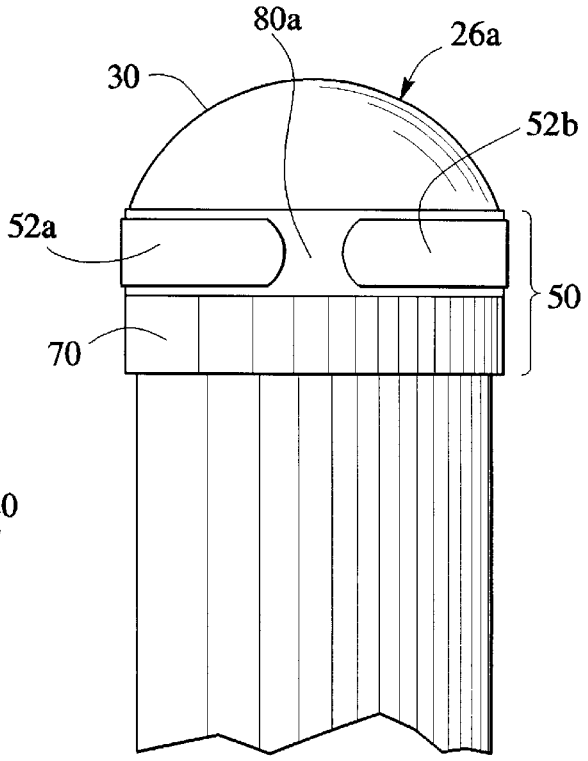
FIG. 3

BOLLARD CAP

BACKGROUND OF THE INVENTION

The present invention relates to guard posts or "bollards" which are in widespread use for protecting objects from vehicular traffic or any type of impact.

Bollards are conventionally used to protect objects such as gas meters, electric boxes, transformers, storefronts, drive up service windows, etc. A conventional bollard consists of a length of steel pipe, typically 3" or 4" diameter, arranged vertically and sunk a sufficient depth into the ground, and filled with concrete. Typically, a cylindrical hole is provided for placing the bollard and the bollard is surrounded by concrete beneath the surface to act as a stabilizing foundation for the bollard. The bollard is filed with concrete and a top open end of the bollard is finished off with either a welded steel cap or the concrete is formed into a semi-sphere for decorative purposes and to provide rain run-off.

These hand formed concrete semi-spheres deteriorate over time, are not uniform in appearance, and are detrimental to the aesthetic appearance of the bollard, and particularly give a more crude appearance to the bollard when located in an otherwise aesthetically pleasing location, e.g., when the bollard is located at an "upscale' restaurant, and non-industrial locations. A welded cap bollard also produces an industrial and somewhat crude appearance, especially if the resultant weld is not ground smooth and the bollard painted. These latter steps of manufacturing add significantly to the cost of installation of the bollard.

SUMMARY OF THE INVENTION

It is an object of the present invention to provide a cap for a bollard which is aesthetically pleasing, easily installed, can serve as a containment for electronic equipment, or surveillance equipment, provides a reflecting surface for traffic safety, is easily installed, and can be color coded for the appropriate service.

The bollard cap of the invention is advantageously constructed having a dome which continues into a sleeve for fitment around a pipe shaped bollard. The dome has an anchor shaft welded thereto proceeding downwardly which is placed downwardly into wet concrete held within the bollard. A reflective band can be provided to snap around the sleeve of the bollard cap. The bollard cap can be designed to fit any size bollard.

The bollard cap is more resistant to deterioration, and can be color coded to coordinate with the object being protected such as a gas meter, electric boxes, transformers, etc. The bollard cap can be made decorative and enhance the appearance of the location, such as when used in conjunction with a building. The bollard caps are lightweight, durable and easy to install compared to hand formed concrete caps or welded caps. During installation the bollard caps can be easily installed to bollards without need for hand forming or welding as with the prior conventional caps.

Additionally, the bollard cap provides a cylindrical surface such that the name of the business can be embossed or printed on the cap. For example, the proprietary name of the store where the bollard caps are located could be embossed on the caps such as: WAL-MART or WALGREENS. Additionally, other information can be embossed or preprinted on the cap such as "No Parking", "Exit", etc. The bollard caps are designed to be permanent, lightweight, economical, and highly visible, and can be made to fit any bollard. The caps can be translucent or transparent and illuminated by an inside lamp, particularly effective with embossed or printed caps. Compared to the prior known hand formed concrete caps which deteriorate over time, are not uniform and do not enhance the aesthetic beauty of their surroundings, or the welded caps which only provide cover at the end of the bollard, the present invention provides these numerous above recited advantages.

In an alternate embodiment of the invention, the bollard cap can be fashioned to contain electronic equipment and other related equipment. The bollard cap can contain for example: security equipment such as cameras, motion sensors, optical sensors, such as an optical beam generator or receiver, and audio components for producing an alarm or giving audible instructions or warnings. A portion of the bollard cap sleeve can be clear plastic for the passage of light into or out of the bollard cap. A portion of the sleeve can be perforated to pass audible sounds or inaudible sound waves through the sleeve. A reflector band can be provided adjacent the clear plastic or perforated portion for traffic safety.

As a security device, a visual monitor, such as a camera, can be provided in the cap that keeps constant surveillance of the immediate area, and an audio component can be provided to emit a burst of sound when security is breached, such as when a vehicle is parked near the bollard to attract attention to the vehicle or warn the vehicle away. The visual monitor and audio component can be activated in a number or ways, including: a vehicle weight activated cable-and-switch laid under a pavement area adjacent to the bollard; a motion detector located within the bollard cap; or an optical detector such as by a beam interruption detector, the beam projected between two adjacent bollards having compatible optical beam equipment, or other security sensors located within, or external to, the bollard cap.

The bollard cap can be provided with a security camera which constantly monitors the area of the bollard, or can be activated only intermittently, triggered to monitor by the motion detector or by the vehicle weight sensor or by the optical sensor, or other sensor.

The surveillance or alarm bollards can be installed in several different locations around a building or other secured area, forming an effective security system against burglary or terrorism. The bollard system is effective to block vehicle access to restricted or secure areas to prevent property damage or injury to persons and can provide a visual record of activity in the area.

Other objects and advantages of the present invention will be apparent upon reference to the accompanying description when taken in conjunction with the following drawings.

BRIEF DESCRIPTION OF THE DRAWINGS

FIG. 1 is a perspective view of a bollard according to the present invention;

FIG. 2 is an elevational view of the bollard shown in FIG. 1;

FIG. 3 is an elevational view of an alternate embodiment bollard;

DETAILED DESCRIPTION OF THE PREFERRED EMBODIMENTS

Figure 4:
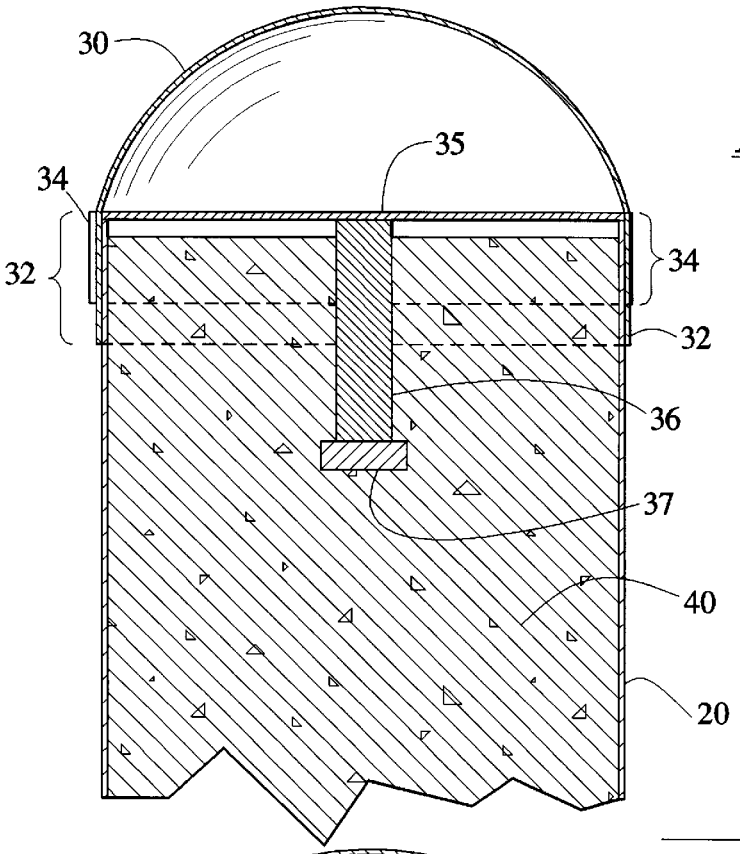
FIG. 4 is a longitudinal sectional view of the bollard shown in FIG. 2.

FIG. 1 illustrates a bollard 10 installed into the ground G into a concrete base 16 located below grade level. The bollard 10 is located near to for example a drive-up window 17 of a store or a bank, or a food service 18 to protect the window 17 from impact from a vehicle 19. The bollard is composed of a pipe 20, typically 3" in diameter and made of steel, extending vertically upward. The base 16 is advantageously 2 foot by 2 foot by 1 foot thick, although the pipe can also be installed with a concrete cylindrical socket instead. A bollard cap 26 overfits a top end 28 of the pipe 20 to complete the installation.

As shown in FIG. 2 and FIG. 4 the bollard cap includes a dome portion 30 which continues into a sleeve portion 32. The sleeve portion 32 has an inside diameter slightly greater than the outside diameter of the pipe 20 and a length of about 3 inches. A reflective band 34 made of spring steel can be snap engaged around a circumference of the sleeve 32. The reflective band can be painted with a luminescent paint or reflective coating for traffic safety at night to prevent collisions with the bollard. The band is about 2" long. The cap can be formed of ¼" aluminum for lightweightedness, aesthetic appeal and formability.

As shown in FIG. 4, the dome 30 can be closed by a circular floor plate 35. Protruding from the floor plate 35 is an anchor shaft 36 which is typically 6" long and protrudes 5" into concrete 40 which fills the pipe 20. An anchor plate 37 is attached to an end of the shaft 36. The shaft can be made of ½ diameter solid aluminum with ¼" flat plate by 1" by 1" affixed at the bottom, by welding or screw threading. The shaft is welded to a bottom surface of the floor plate 35.

Compared to prior art bollard top formations, the present invention provides an easily installed cap which can be placed down into the wet concrete without need for hand forming or welding. The reflective band increases visibility for traffic safety.

Figure 5:
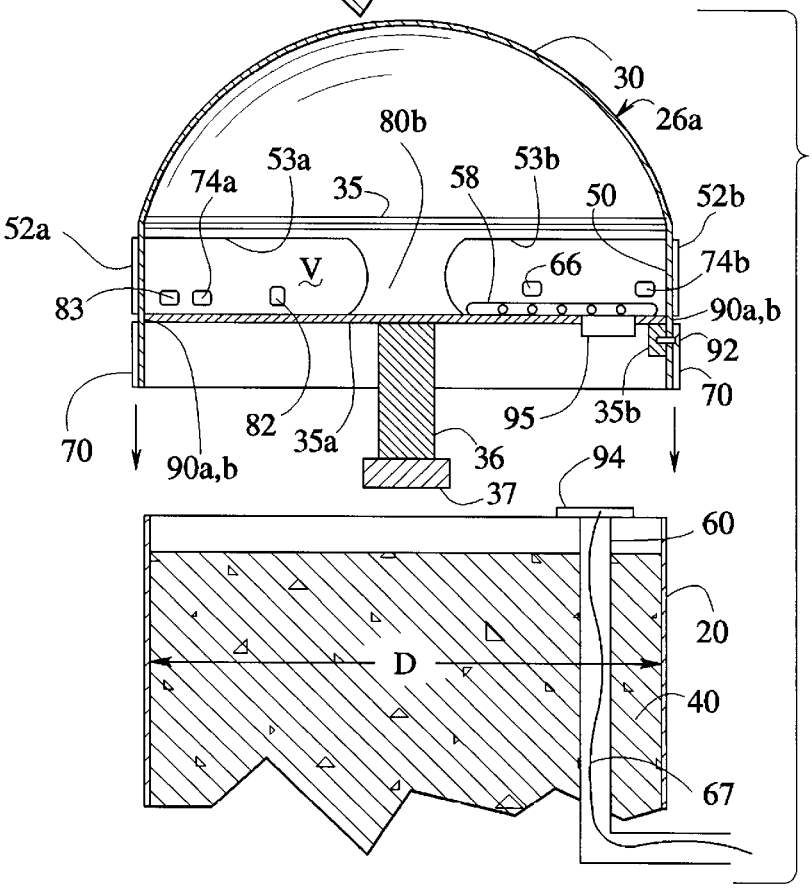
FIG. 5 is a sectional view of the alternate embodiment bollard of the present invention.

FIG. 3 and FIG. 5 illustrate an alternate embodiment demonstrating further advantages of the bollard cap of the present invention.

In the embodiment of FIG. 3, an alternate cap 26*a* includes a sleeve 50 proceeding downwardly from the dome 30 providing an enclosed volume V which can hold electronics and sensors. The sleeve 50 includes hardened plastic, transparent strips 52 *a,b* covering openings or windows 53*a,b* behind which is located motion detectors or optical detectors such as a beam generator or receiver to transform the bollard into a security device. A sensor control box 58 can be provided which, when the bollard cap 26*a* is placed down into the pipe 20, registers with a conduit 60 having electrical conductors and/or optical conductors 62 therein for providing power to the bollard or for transporting signals to-and-from the bollard, such as sensor signals. Additionally, the bollard cap can include an audio component 66 such as a small loudspeaker for providing warnings, alarms, verbal instructions to persons near the bollard, etc. A reflective band 70 can be applied below the electronics compartment as described above.

The dome can be made of transparent material and can be provided with a light therein for aesthetic purposes or for traffic safety. The shaft 36 and anchor plate 37 are attached to a subfloor plate 35*a* which is secured to the sleeve 50.

The embodiment of FIGS. 3 and 5 is not necessary for all applications but is particularly suited for use around secured facilities or areas such as federal buildings, banks, police stations, or other locations where security is essential. A video camera, or still camera, 74*a* or a pair of cameras 74*a,b* can be placed behind the strips 52*a,b* to monitor areas projecting outward from the bollard. The windows 53*a*, 53*b* each wrap around the sleeve slightly less than 180° to allow for two remaining vertical pieces 80*a*, 80*b* of the sleeve 50 for structural strength. Thus the camera or cameras can monitor substantially all around the bollard.

The cameras 74*a,b* can monitor continuously and a video signal therefrom sent to a security station with video monitors or to a video recorder. Alternatively, the camera can be triggered to begin monitoring only when a security breach occurs. This breach can be triggered by a motion detector 82 located within the volume V or by an optical sensor 83 producing an optical beam interrupt signal between two spaced apart bollards. In that case, one bollard would contain a beam emitter and the other a beam receiver.

Also, a vehicle weight triggered cable-and-switch 86 can be provided beneath the paving adjacent the bollard 10' as shown in FIG. 1. The switch 86 is a known device which closes a switch when subjected to pressure from a vehicle weight. The weight of a vehicle above the cable-and-switch 86 sends a signal to trigger the cameras. In addition to triggering the cameras 74*a*, 74*b*, the optical sensor 83, motion detector 82, the cable-and-switch 86 or other disturbance sensor can activate the audio transducer 66 to produce an alarm, audible instructions ("sorry this is a restricted area please stay out"), or other communication. One or both strips 52*a*, 52*b* can be made sound transparent if necessary, by perforations for example, to pass sound through the bollard cap.

The sleeve 50 is threaded onto the sub floor plate 35*a* by engaging threads 90*a,b* applied onto an outside diameter of the plate 35*a* and the inside diameter of the sleeve 50 respectively. Thus the cap 26*a* can be opened for maintenance by unscrewing the sleeve 50 from the plate 35*a* which remains anchored into the concrete 40 by the shaft 36. Special security screws 92, removable only by a specialized tool, positively fix the sleeve 50 to the plate 35*a* and prevent unauthorized tampering. The electronic components are mounted to the plate 35*a*, and can be serviced when the dome 30 and sleeve 50 are removed. The conductor(s) 62 can terminate in a multiconductor plug 94 which connects to a compatible plug 95 during installation of the cap 26*a*.

The embodiment of FIG. 3 and FIG. 5 advantageously employs an 8 inches nominal diameter D steel pipe, approximately ¼ inch thick. Five no. 5 rebar are spaced equally around the inside, running the full length of the pipe. The rebar are held together by No. 4 re-bar rings, spaced 12 inches apart. The cap 26*a* can be made of brass, aluminum, copper or steel, or other materials appropriate for the service. The strips 52*a*, 52*b* are advantageously 2 inches wide and ¼ inch thick.

Although the present invention has been described with reference to a specific embodiment, those of skill in the art will recognize that changes may be made thereto without departing from the scope and spirit of the invention as set forth in the appended claims.

I claim as my invention:

1. A cap for closing an upper end of a bollard, comprising:

a dome section;

a confined space located between said dome section and said bollard as installed;

an electronic component located within said confined space; and an anchor shaft extending downward from said dome section for insertion into an open end of said bollard, said bollard filled with concrete;

wherein said confined space comprises a cylindrical section extending downwardly from said dome section and having a disc shaped wall closing said cylindrical section, said anchor shaft extending from said disc shaped wall downwardly, said cylindrical section having at least one transparent portion for optical communication therethrough.

2. The cap according to claim 1 further comprising a sleeve section connected to said dome section and extending downwardly, said sleeve section having an inside diameter greater than an outside diameter of the bollard for fitment thereover, said anchor shaft extending downwardly through said sleeve section to extend downwardly therefrom.

3. The cap according to claim 2 comprising a reflective band arranged around said sleeve section.

4. The cap according to claim 2 wherein said anchor shaft comprises a rod and a plate connected at an end thereto.

5. The cap according to claim 1 wherein said electronic component comprises a motion detector.

6. The cap according to claim 1 wherein said electronic component comprises an optical sensor.

7. The cap according to claim 1 wherein said cylindrical section has a sound transparent portion and said electronic component comprises a motion detector arranged behind said sound transparent portion.

8. The cap according to claim 1 further comprising a further cylindrical section adjacent said confined space, said further cylindrical section having a reflective band therearound.

9. The cap according to claim 1 wherein said electronic component comprises;

a surveillance device located within said dome section behind said transparent portion.

10. The cap according to claim 9 further comprising a security sensor, said surveillance device being signal connected to said security sensor to instigate surveillance once said security sensor senses a breach of security.

11. The cap according to claim 10 further comprising an audio transducer, and said security sensor is signal connected to said audio transducer to activate said audio transducer to produce an audible alarm when a breach in security is sensed.

12. The cap according to claim 10 wherein said security sensor is selected from the group consisting of a motion detector, an optical beam interrupt detector and a vehicle weight detector.

13. The cap according to claim 9 wherein said surveillance device comprises a video camera.

14. The cap according to claim 1 wherein said cylindrical section and said disc shaped wall are screw threaded together.

15. The cap according to claim 1 wherein the electric component is selected from the group consisting of: audio transducer; motion detector; video camera; still camera; optical beam detector.

16. The cap according to claim 1 wherein said cylindrical section is removably attached to said disc shaped wall.

17. A bollard assembly comprising:

a pipe extending downward into a surrounding surface;

a cylindrical volume of concrete filling said pipe;

a dome section forming a cap closing an open top end of said pipe;

a confined space located between said dome section and said pipe as installed;

an electronic component located within said confined space;

an anchor shaft extending downward from said dome section for insertion into said open top end of said pipe; and a first cylindrical section extending downwardly from said dome section and having a disc shaped wall closing said first cylindrical section, said anchor shaft extending from said disc shaped wall downwardly, said first cylindrical section having at least one transparent portion for optical communication therethrough.

18. The bollard according to claim 17, wherein said dome section has a second cylindrical section extending from said first cylindrical section downwardly beyond said disc shaped wall with an open bottom end, said open bottom end sized to have a slightly greater diameter than an outside diameter of said pipe for fitment thereon.

19. The bollard according to claim 18, wherein said cap further comprises a reflective band surrounding said first cylindrical section.

20. The bollard according to claim 17 further comprising:

a signal conductor arranged within said concrete and extending upwardly to said electronic component.

21. The bollard according to claim 17 wherein said electronic component comprises a motion detector.

22. The bollard according to claim 17 wherein said electronic component comprises an optical sensor.

23. The bollard according to claim 17 wherein said cap comprises a sound transparent portion, and said electronic component comprises a sound sensor arranged in said confined space adjacent said sound transparent portion.

24. The bollard according to claim 17 wherein said cap comprises a sound transparent portion and said electronic component comprises an audio transducer arranged with said confined space adjacent said sound transparent portion.

25. The bollard according to claim 17 further comprising a reflective band arranged adjacent said confined space.

* * * * *